US006220976B1

(12) United States Patent
Kaiser et al.

(10) Patent No.: US 6,220,976 B1
(45) Date of Patent: Apr. 24, 2001

(54) MODIFIED GOAL POST

(76) Inventors: Jerry Kaiser; Dawn Kaiser; Dana Kaiser, all of R. R. 2 Box 11, Lake Park, MN (US) 56554

( * ) Notice: Subject to any disclaimer, the term of this patent is extended or adjusted under 35 U.S.C. 154(b) by 0 days.

(21) Appl. No.: 09/415,010

(22) Filed: Oct. 8, 1999

(51) Int. Cl.[7] ..... A63B 63/00
(52) U.S. Cl. ..... 473/476; 473/439; 273/343
(58) Field of Search ..... 273/331, 343, 273/348, 390, 407, 127 R, 398, 401, 402; 473/421, 430, 462, 476, 479, FOR 104, FOR 108, FOR 213, FOR 229, 454, 456, 478

(56) References Cited

U.S. PATENT DOCUMENTS

D. 250,283 11/1978 Norton .
1,529,893 * 3/1925 Kastner ..... 273/343
2,845,269 7/1958 Simmons .
3,680,862 8/1972 Russell et al. .
4,029,318 * 6/1977 Boss ..... 273/390
4,092,023 5/1978 Hazen .
4,295,648 * 10/1981 Stromback ..... 473/456
4,718,668 * 1/1988 Schipske ..... 473/462
4,826,166 * 5/1989 Baker et al. ..... 473/439
5,280,904 * 1/1994 Rodriguez ..... 473/439
5,290,043 3/1994 Vidinic .

* cited by examiner

*Primary Examiner*—Jeanette Chapman
*Assistant Examiner*—Mitra Aryanpour

(57) ABSTRACT

A modified goal post is provided including an upstanding post, a large frame mounted on the post, and a small frame mounted within the frame.

7 Claims, 1 Drawing Sheet

MODIFIED GOAL POST

BACKGROUND OF THE INVENTION

1. Field of the Invention

The present invention relates to goal posts and more particularly pertains to a new modified goal post for providing a goal post which allows various ways of scoring.

2. Description of the Prior Art

The use of goal posts is known in the prior art. More specifically, goal posts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,845,269; U.S. Pat. No. 5,280,904; U.S. Pat. No. 3,680,862; U.S. Pat. No. 4,092,023; U.S. Pat. No. 5,290,043; and U.S. Pat. No. Des. 250,283.

In these respects, the modified goal post according to the present invention substantially departs from the conventional concepts and designs of the prior art, and in so doing provides an apparatus primarily developed for the purpose of providing a goal post which allows various ways of scoring.

SUMMARY OF THE INVENTION

In view of the foregoing disadvantages inherent in the known types of goal posts now present in the prior art, the present invention provides a new modified goal post construction wherein the same can be utilized for providing a goal post which allows various ways of scoring.

The general purpose of the present invention, which will be described subsequently in greater detail, is to provide a new modified goal post apparatus and method which has many of the advantages of the goal posts mentioned heretofore and many novel features that result in a new modified goal post which is not anticipated, rendered obvious, suggested, or even implied by any of the prior art goal posts, either alone or in any combination thereof.

To attain this, the present invention generally comprises a vertically oriented central post having a bottom end mounted in a recipient surface and a top end. Also included is a large substantially rectangular frame including a linear, horizontally oriented lower bar coupled at a central extent thereof to the top end of the central post. The lower bar has a pair of ends. Associated therewith is a pair of linear, vertically oriented side bars each having a bottom end coupled to one of the ends of the lower bar and extending upwardly therefrom in perpendicular relationship therewith. It should be noted that the side bars each have a length approximately one and one half to two times that of the lower bar. Most ideally, the length of the side bars is about 1.62 times the length of the lower bar. The large frame further includes an upper assembly including a linear, horizontally oriented upper bar with a length about equal to that of the lower bar. As shown in FIG. 1, a pair of linear, vertically oriented lateral members are each coupled to one of the ends of the upper bar and extend downwardly therefrom a predetermined distance. Such lateral members further extend upwardly from the upper bar a distance at least twice the predetermined distance. Bottom ends of the lateral members are coupled to the top ends of the side bars for defining a large rectangular frame. Finally, an intermediate assembly is provided including a small rectangular frame defined by a pair of linear, vertically oriented elongated side parts and a pair of linear, horizontally oriented short end parts. As shown in FIG. 1, an area encompassed by the small frame is about 11% that of that encompassed by the large frame. The intermediate assembly further includes an interconnect between a central extent of the upper bar and a central extent of one of the end parts for maintaining the frames fixed with respect to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modified goal post apparatus and method which has many of the advantages of the goal posts mentioned heretofore and many novel features that result in a new modified goal post which is not anticipated, rendered obvious, suggested, or even implied by any of the prior art goal posts, either alone or in any combination thereof.

It is another object of the present invention to provide a new modified goal post which may be easily and efficiently manufactured and marketed.

It is a further object of the present invention to provide a new modified goal post which is of a durable and reliable construction.

An even further object of the present invention is to provide a new modified goal post which is susceptible of a low cost of manufacture with regard to both materials and labor, and which accordingly is then susceptible of low prices of sale to the consuming public, thereby making such modified goal post economically available to the buying public.

Still yet another object of the present invention is to provide a new modified goal post which provides in the apparatuses and methods of the prior art some of the advantages thereof, while simultaneously overcoming some of the disadvantages normally associated therewith.

Still another object of the present invention is to provide a new modified goal post for providing a goal post which allows various ways of scoring.

Even still another object of the present invention is to provide a new modified goal post that includes an upstanding post, a large frame mounted on the post, and a small frame mounted within the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
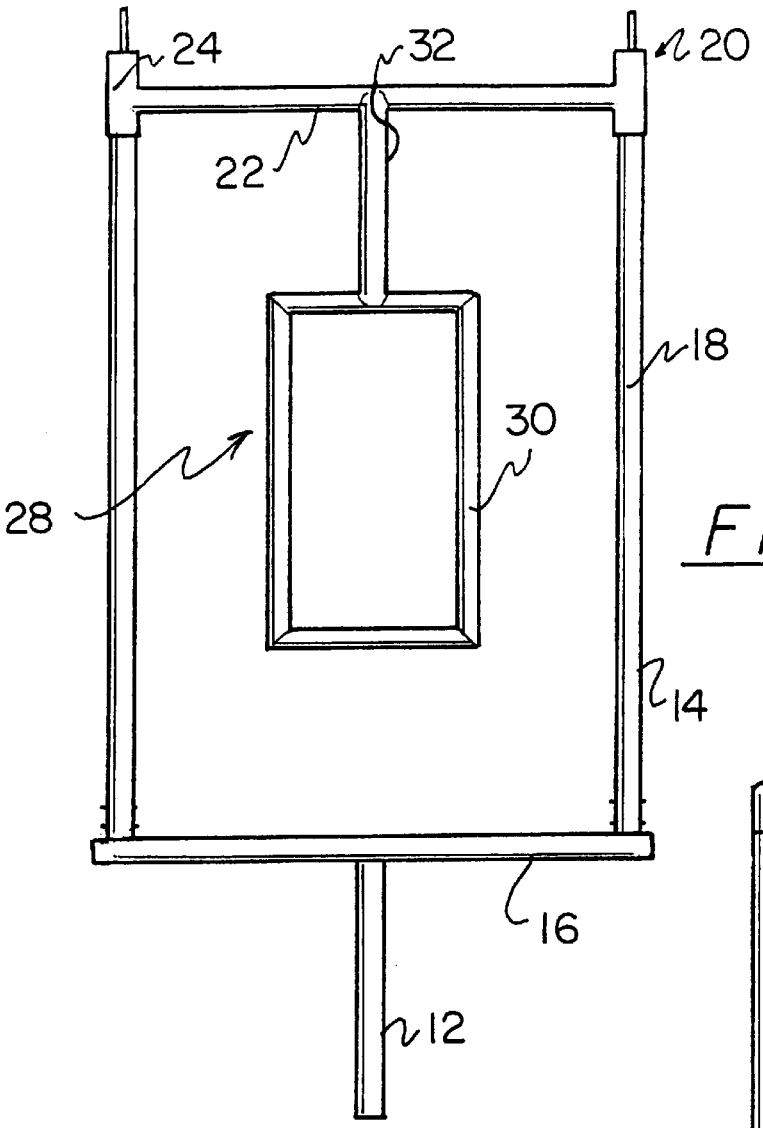
FIG. 1 is a front view of a new modified goal post according to the present invention.
Figure 2:
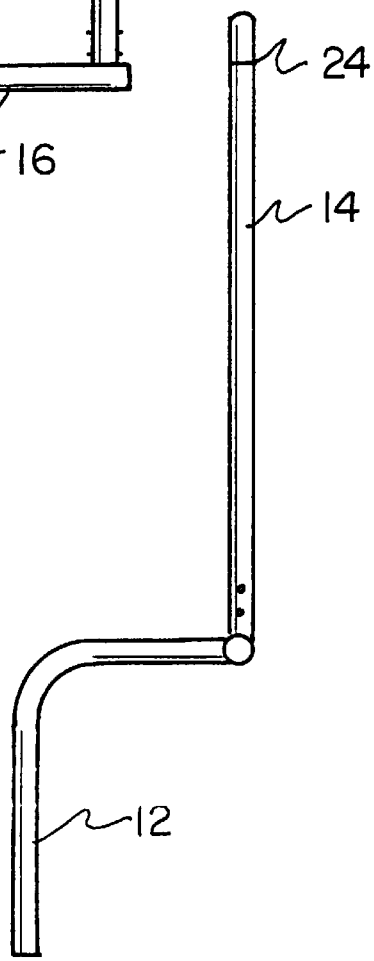
FIG. 2 is a side view of an alternate embodiment of the present invention.

With reference now to the drawings, and in particular to FIGS. 1 through 2 thereof, a new modified goal post embodying the principles and concepts of the present invention and generally designated by the reference numeral 10 will be described.

The present invention, designated as numeral 10, includes an arcuate vertically oriented central post 12 having a bottom end mounted in a recipient surface and a top end.

Also included is a large substantially rectangular frame 14 including a linear, horizontally oriented lower bar 16 coupled at a central extent thereof to the top end of the central post. The lower bar has a pair of ends. Associated therewith is a pair of linear, vertically oriented side bars 18 each having a bottom end coupled to one of the ends of the lower bar and extending upwardly therefrom in perpendicular relationship therewith. Ideally, the bottom ends of the side bars are received by male couples extending upwardly from the lower bar and further coupled thereto by way of bolts and nuts. Further, the ends of the lower bar preferably extend beyond the side bars about 1–2 inches, as shown in FIG. 1. It should be noted that the side bars each have a length approximately one and one half to about two times the length of the lower bar. Most ideally, the length of the side bars are about 1.62 times the length of the lower bar.

The large frame further includes an upper assembly 20 including a linear, horizontally oriented upper bar 22 with a length about equal to that of the lower bar. As shown in FIG. 1, a pair of linear, vertically oriented lateral members 24 are each coupled to one of the ends of the upper bar and extend downwardly therefrom a predetermined distance. Such lateral members further extend upwardly from the upper bar a distance at least twice the predetermined distance in order to facilitate wind direction flags and allow referees to visually judge the invisible extension of the uprights. Bottom ends of the lateral members are coupled to the top ends of the side bars for defining a large rectangular frame.

Finally, an intermediate assembly 28 is provided including a small rectangular frame 30 defined by a pair of linear, vertically oriented elongated side parts and a pair of linear, horizontally oriented short end parts. As shown in FIG. 1, an area encompassed by the small frame is about 11% of an area encompassed by the large frame. The intermediate assembly further includes an interconnect 32 between a central extent of the upper bar and a central extent of one of the end parts for maintaining the frames fixed with respect to each other. Ideally, the parts of the small frame of the intermediate assembly have a small cross-section. In use, during the course of a game for a field goal, kicking a ball through the large frame rewards an intermediate amount of points, kicking the ball through the small frame rewards the most amount of points, and passing the ball directly above the upper bar of the large frame awards the least amount of points. Illustratively, kicking a ball through the large frame rewards 4 points, kicking the ball through the small frame rewards 5 points, and kicking the ball directly above the upper bar of the large frame awards 3 points.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modified goal post comprising, in combination:

a vertically oriented central post having a bottom end mounted in a recipient surface and a top end;

a linear horizontally oriented lower bar coupled at a central extent thereof to the top end of the central post, wherein the lower bar has a pair of ends;

a pair of linear, vertically oriented side bars each having a bottom end coupled to one of the ends of the lower bar and extending upwardly therefrom in perpendicular relationship therewith, wherein the side bars each have a length in the range of about 1½ to about 2 times the length of the lower bar;

an upper assembly including a linear, horizontally oriented upper bar with a length about equal to that of the lower bar and a pair of linear, vertically oriented lateral members each being coupled to one of the ends of the upper bar and extending downwardly therefrom a predetermined distance and further extending upwardly therefrom a distance at least twice the predetermined distance, wherein bottom ends of the lateral members are coupled to the top ends of the side bars for defining a large rectangular frame:

an intermediate assembly including a small rectangular frame defined by a pair of linear, vertically oriented elongated side parts and a pair of linear, horizontally oriented short end parts, wherein an area encompassed by the small frame is approximately 11% that of that encompassed by the large frame, the intermediate assembly further including an interconnection between a central extent of the upper bar and a central extent of one of the end parts; and wherein the interconnect has a width that is about equal to a width of one of the side bars such that the width of the interconnect facilitates passage of a ball through the area of the large frame above an uppermost one of the short end parts of the intermediate assembly.

2. A modified goal post comprising:

an upstanding post;

a large frame mounted on the post;

a small frame mounted in the large frame;

a pair of members extending upwardly from a top bar of the large frame; and an intermediate assembly including said small rectangular frame defined by a pair of linear, vertically oriented elongated side parts and a pair of linear, horizontally oriented short end parts, the intermediate assembly further including an interconnect coupled for coupling the small frame to the large frame; and wherein the interconnect has a width that is about equal to a width of one of a pair of side bars of the large frame such that the width of the interconnect facilitates passage of a ball through the area of the large frame above an uppermost one of the short end parts of the intermediate assembly;

wherein the interconnect between the small frame and the large frame is rigidly connected to the central extent of the upper bar of the large frame and the one of the end parts of the small frame for maintaining the small frame in substantially the same plane as the large frame when the small frame is struck by an object.

3. The modified goal post as set forth in claim 2 wherein the frames are substantially rectangular in shape.

4. The modified goal post as set forth in claim 2 wherein the frames are axially aligned.

5. The modified goal post as set forth in claim 2 wherein the frames reside in coplanar relationship.

6. The modified goal post as set forth in claim 2 wherein an area encompassed by the small frame is approximately 11% that of that encompassed by the large frame.

7. The modified goal post as set forth in claim 1 wherein the interconnect between the small frame and the large frame is rigidly connected to the central extent of the upper bar of the large frame and the one of the end parts of the small frame for maintaining the small frame in substantially the same plane as the large frame when the small frame is struck by an object.

* * * * *